US006219637B1

(12) United States Patent
Choi et al.

(10) Patent No.: US 6,219,637 B1
(45) Date of Patent: Apr. 17, 2001

(54) SPEECH CODING/DECODING USING PHASE SPECTRUM CORRESPONDING TO A TRANSFER FUNCTION HAVING AT LEAST ONE POLE OUTSIDE THE UNIT CIRCLE

(75) Inventors: Hung Bun Choi, Shatin (HK); Xiaoqin Sun, Plainsboro, NJ (US); Barry Michael George Cheetham, Liverpool (GB)

(73) Assignee: Bristish Telecommunications public limited company, London (GB)

( * ) Notice: Subject to any disclaimer, the term of this patent is extended or adjusted under 35 U.S.C. 154(b) by 0 days.

(21) Appl. No.: 09/029,832

(22) PCT Filed: Jul. 28, 1997

(86) PCT No.: PCT/GB97/02037

§ 371 Date: Mar. 10, 1998

§ 102(e) Date: Mar. 10, 1998

(87) PCT Pub. No.: WO98/05029

PCT Pub. Date: Feb. 5, 1998

(30) Foreign Application Priority Data

Jul. 30, 1996 (EP) ..... 96305576

(51) Int. Cl.[7] ..... G10L 19/08

(52) U.S. Cl. ..... 704/223; 704/230; 704/264

(58) Field of Search ..... 704/201, 200, 704/230, 229, 223, 205, 206, 222, 264

(56) References Cited

U.S. PATENT DOCUMENTS

| | | | | |
|---|---|---|---|---|
| 4,475,227 | * | 10/1984 | Belfield | 704/212 |
| 4,626,828 | * | 12/1986 | Nishitani | 341/51 |
| 4,782,523 | * | 11/1988 | Galand et al. | 379/386 |
| 4,969,192 | * | 11/1990 | Chen et al. | 704/222 |
| 5,862,227 | * | 1/1999 | Orduna-Bustamante et al. | 381/17 |

FOREIGN PATENT DOCUMENTS

| | | | |
|---|---|---|---|
| 0259950 A1 | 3/1988 | (EP) | G10L/7/06 |
| 0698876 A2 | 2/1996 | (EP) | G10L/7/06 |

OTHER PUBLICATIONS

Ozawa, A 4.8 kb/s High–Quality Speech Coding Using Various Types of Excitation Signals, Proceedings of the European Conference on Speech Communication and Technology (Eurospeech), Paris, Sep. 26–28, 1989, vol. 1, Sep. 26, 1989, pp. 306–309.

McAulay et al, "19 Sine–Wave Amplitude Coding at Low Data Rates", Advances in Speech Coding, Vancouver, Sep. 5–8, 1989, Jan. 1, 1991, pp. 203–213.

Arjmand et al, "Pitch–Congruent Baseband Speech Coding", Proceedings of ICASSP 83, IEEE International Conference on Acoustics, Speech and Signal Processing, Boston, MA, Apr. 14–16, 1983, 1983 New York, NY IEEE USA, pp. 1324–1327, vol.3.

Kleijn, "Continuous Representations in Linear Predictive Coding", IEEE, 1991.

Kleijn et al, "A General Waveform–Interpolation Structure for Speech Coding", Signal Processing, pp. 1665–1668, 1994.

Kleijn et al, "A Speech Coder Based on Decomposition of Characteristic Waveforms", 1995, IEEE, pp. 508–511.

McAulay et al, "Speech Analysis/Synthesis Based on a Sinusoidal Representation", IEEE Transactions on Acoustics, Speech, and Signal Processing, vol. ASSP–34, No. 4, Aug. 1986, pp. 744–754.

Rosenberg, "Effect of Glottal Pulse Shape on the Quality of Natural Vowels", The Journal of the Acoustical Society of America, pp. 583–590, Apr. 1970.

* cited by examiner

*Primary Examiner*—Richemond Dorvil
(74) *Attorney, Agent, or Firm*—Nixon & Vanderhye P.C.

(57) ABSTRACT

A decoder for speech signals receives magnitude spectral information for synthesis of a time-varying signal. From the magnitude spectral information, phase spectrum information is computed corresponding to a minimum phase filter which has a magnitude spectrum corresponding to the magnitude spectral information. From the magnitude spectral information and the phase spectral information, a time-varying signal is generated. The phase spectrum of the signal is modified by phase adjustment.

14 Claims, 4 Drawing Sheets

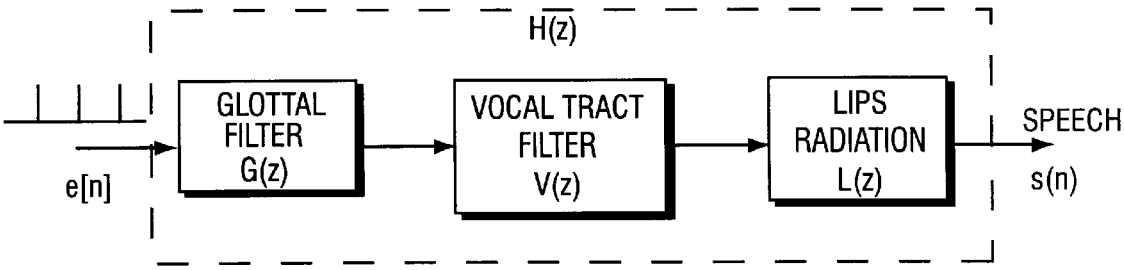
FIG. 2 MODEL OF SPEECH PRODUCTION
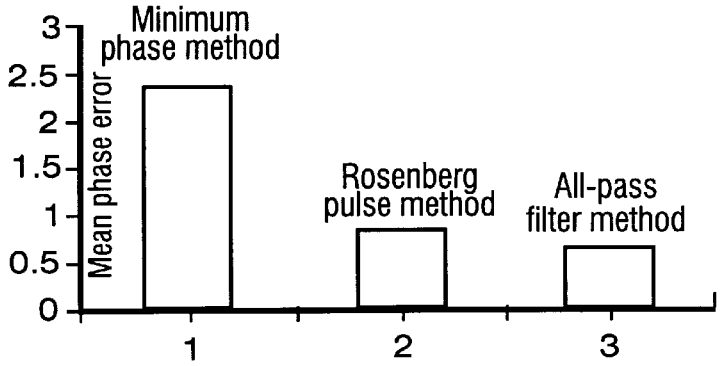
FIG. 4 MEAN PHASE ERROR
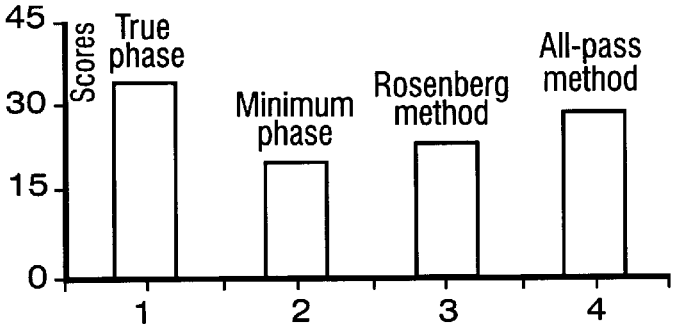
FIG. 5
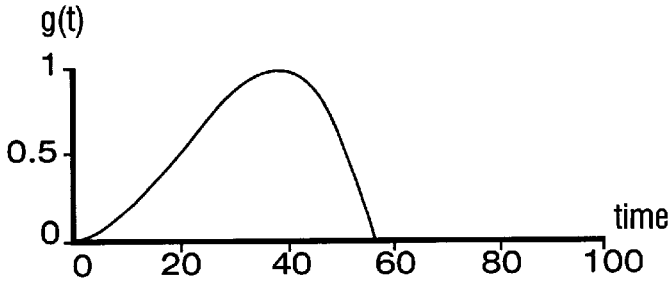
FIG. 6 AN EXAMPLE OF ROSENBERG PULSE WITH PITCH PERIOD = 100 SAMPLES

SPEECH CODING/DECODING USING PHASE SPECTRUM CORRESPONDING TO A TRANSFER FUNCTION HAVING AT LEAST ONE POLE OUTSIDE THE UNIT CIRCLE

BACKGROUND OF THE INVENTION

1. Field of the Invention

The present invention is concerned with speech coding and decoding, and especially with systems in which the coding process fails to convey all or any of the phase information contained in the signal being coded.

2. Related Art

A known speech coder and decoder is shown in FIG. 1 and is further discussed below. However, such prior art is based on assumptions regarding the phase spectrum which can be further improved.

SUMMARY OF THE INVENTION

According to one aspect of the present invention there is provided a decoder for speech signals comprising:

means for receiving magnitude spectral information for synthesis of a time-varying signal;

means for computing, from the magnitude spectral information, phase spectrum information corresponding to a minimum phase filter which has a magnitude spectrum corresponding to the magnitude spectral information;

means for generating, from the magnitude spectral information and the phase spectral information, the time-varying signal; and phase adjustment means operable to modify the phase spectrum of the signal.

In another aspect the invention provides a decoder for decoding speech signals comprising information defining the response of a minimum phase synthesis filter and, for synthesis of an excitation signal, magnitude spectral information, the decoder comprising:

means for generating, from the magnitude spectral information, an excitation signal;

a synthesis filter controlled by the response information and connected to filter the excitation signal; and phase adjustment means for estimating a phase-adjustment signal to modify the phase of the signal.

In a further aspect, the invention provides a method of coding and decoding speech signals, comprising:

(a) generating signals representing the magnitude spectrum of the speech signal;

(b) receiving the signals;

(c) generating from the received signals a synthetic speech signal having a magnitude spectrum determined by the received signals and having a phase spectrum which corresponds to a transfer function having, when considered as a z-plane plot, at least one pole outside the unit circle.

BRIEF DESCRIPTION OF DRAWINGS

Some embodiments of the invention will now be described, by way of example, with reference to the accompanying drawings, in which:

FIG. 2 illustrates a model of the human vocal system;

FIGS. 4 and 5 are charts showing test results obtained for the decoder of FIG. 3;

FIG. 6 is a graph of the shape of a (known) Rosenberg pulse;

DETAILED DESCRIPTION OF EXEMPLARY EMBODIMENTS

Figure 1:
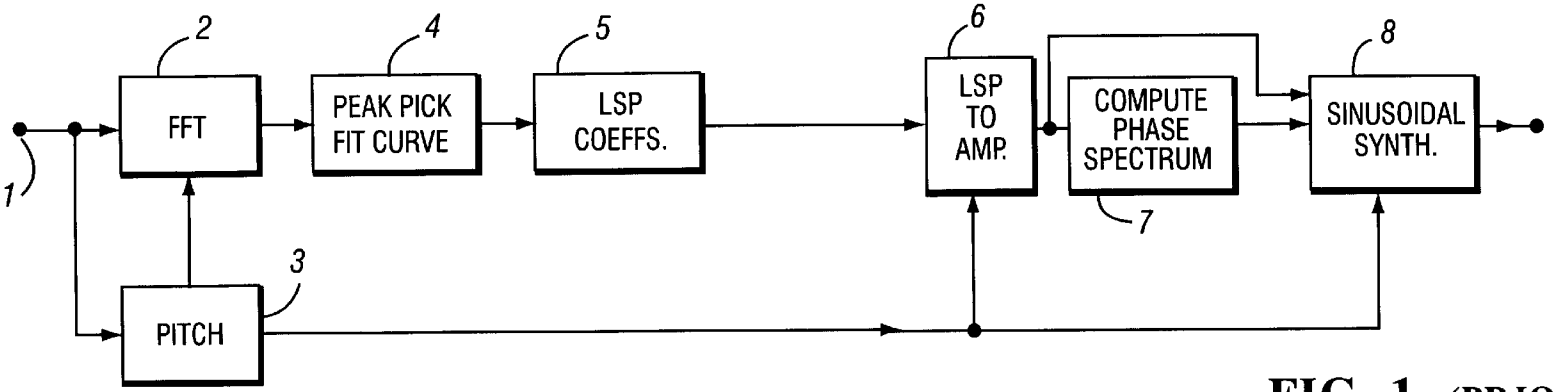
FIG. 1 (PRIOR ART)
FIG. 1 is a block diagram of a known speech coder and decoder.

This first example assumes that a sinusoidal transform coding (STC) technique is employed for the coding and decoding of speech signals. This technique was proposed by McAulay and Quatieri and is described in their paper "Speech Analysis/Synthesis based on a Sinusoidal Representation", R. J. McAulay and T. F. Quatieri, IEEE Trans. Acoust. Speech Signal Process. ASSP-34, pp. 744–754, 1986; and "Low-rate Speech Coding based on the Sinusoidal Model" by the same authors, in "Advances in Speech Signal Processing", Ed. S. Furui and M. M. Sondhi, Marcel Dekker Inc., 1992. The principles are illustrated in FIG. 1 where a coder receives speech samples s(n) in digital form at an input 1; segments of speech of typically 20 ms duration are subject to Fourier analysis in a Fast Fourier Transform unit 2 to determine the short term frequency spectrum of the speech. Specifically it is the amplitudes and frequencies of the peaks in the magnitude spectrum that are of interest, the frequencies being assumed—in the case of voiced speech—to be harmonics of a pitch frequency which is derived by a pitch detector 3. The phase spectrum is, in the interests of transmission efficiency, not to be transmitted and a representation of the magnitude spectrum, for transmission to a decoder, is in this example obtained by fitting an envelope to the magnitude spectrum and characterising this envelope by a set of coefficients (e.g. LSP (line spectral pair) coefficients). This function is performed by a conversion unit 4 which receives the Fourier coefficients and performs the curve fit and a unit 5 which converts the envelope to LSP coefficients which form the output of the coder.

The corresponding decoder is also shown in FIG. 1. This receives the envelope information, but, lacking the phase information, has to reconstruct the phase spectrum based on some assumption. The assumption used is that the magnitude spectrum represented by the received LSP coefficients is the magnitude spectrum of a minimum-phase transfer function—which amounts to the assumption that the human vocal system can be regarded as a minimum phase filter impulsively excited. Thus a unit 6 derives the magnitude spectrum from the received LSP coefficients and a unit 7 calculates the phase spectrum which corresponds to this magnitude spectrum based on the minimum phase assumption. From the two spectra a sinusoidal synthesiser 8 generates the sum of a set of sinusoids, harmonic with the pitch frequency, having amplitudes and phases determined by the spectra.

In sinusoidal speech synthesis, a synthetic speech signal y(n) is constructed by the sum of sine waves:

$$y(n) = \sum_{k=1}^{N} A_k \cos(\omega_k n + \phi_k) \quad (1)$$

where $A_k$ and $\phi_k$ represent the amplitude and phase of each sine wave component associated with the frequency track $\omega_k$, and N is the number of sinusoids.

Although this is not a prerequisite, it is common to assume that the sinusoids are harmonically related, thus:

$$y(n) = \sum_{k=1}^{N} A_k \cos(\psi_k + \phi_k) \quad (2)$$

where $$\psi_k(n)=k\omega_0(n)n \quad (3)$$

where $\phi_k(n)$ represents the instantaneous relative phase of the harmonics, $\psi_k(n)$ represents the instantaneous linear phase component, and $\omega_0(n)$ is the instantaneous fundamental pitch frequency.

A simple example of sinusoidal synthesis is the overlap and add technique. In this scheme $A_k(n)$, $\omega_0(n)$ and $\psi_k(n)$ are updated periodically, and are assumed to be constant for the duration of a short, for example 10 ms, frame. The i'th signal frame is thus synthesised as follows:

$$y^i(n) = \sum_{k=1}^{N^i} A_k^i \cos(k\omega_n^i n + \phi_k^i) \quad (4)$$

Note that this is essentially an inverse discrete Fourier transform. Discontinuities at frame boundaries are avoided by combining adjacent frames as follows:

$$\hat{y}^i(n)=W(n)y^{i-1}(n)+W(n-T)y^i(n-T) \quad (5)$$

where W(n) is an overlap and add window, for example triangular or trapezoidal, T is the frame duration expressed as a number of sample periods and $$W(n)+W(n-T)=1 \quad (6)$$

In an alternative approach, y(n) may be calculated continuously by interpolating the amplitude and phase terms in equation 2. In such schemes, the magnitude component $A_k(n)$ is often interpolated linearly between updates, whilst a number of techniques have been reported for interpolating the phase component. In one approach (McAulay and Quatieri) the instantaneous combined phase ($\Psi_k(n)+\phi(n)$) and pitch frequency $\omega_o(n)$ are specified at each update point. The interpolated phase trajectory can then be represented by a cubic polynomial. In another approach (Kleijn) $\psi_k(n)$ and $\phi(n)$ are interpolated separately. In this case $\phi(n)$ is specified directly at the update points and linearly interpolated, whilst the instantaneous linear phase component $\psi_k(n)$ is specified at the update points in terms of the pitch frequency $\omega_0(n)$, and only requires a quadratic polynomial interpolation.

From the discussion presented above, it is clear that a sinusoidal synthesiser can be generalised as a unit that produces a continuous signal y(n) from periodically updated values of $A_k(n)$, $\omega_0(n)$ and $\phi_k(n)$. The number of sinusoids may be fixed or time-varying.

Thus we are interested in sinusoidal synthesis schemes where the original phase information is unavailable and $\phi_k$ must be derived in some manner at the synthesiser.

Whilst the system of FIG. 1 produces reasonably satisfactory results, the coder and decoder now to be described offers alternative assumptions as to the phase spectrum. The notion that the human vocal apparatus can be viewed as an impulsive excitation e(n) consisting of a regular series of delta functions driving a time-varying filter H(z) (where z is the z-transform variable) can be refined by considering H(z) to be formed by three filters, as illustrated in FIG. 2, namely a glottal filter 20 having a transfer function G(z), a vocal tract filter 21 having a transfer function V(z) and a lip radiation filter 22 with a transfer function L(z). In this description, the time-domain representations of variables and the impulse responses of filters are shown in lower case, whilst their z-transforms and frequency domain representations are denoted by the same letters in upper case. Thus we may write for the speech signal s(n):

$$s(n)=e(n)\otimes h(n)=e(n)\otimes g(n)\otimes v(n)\otimes l(n) \quad (7)$$

or $$S(z)=E(z)H(z)=E(z)G(z)V(z)L(z) \quad (8)$$

Since the spectrum of e(n) is a series of lines at the pitch frequency harmonics, it follows that at the frequency of each harmonic the magnitude of s is:

$$|S(e^{jw})|=|E(e^{jw})||H(e^{jw})|=A|H(e^{jw})| \quad (9)$$

where A is a constant determined by the amplitude of e(n). and the phase is:

$$\arg(S(e^{jw}))=\arg(E(e^{jw}))+\arg(H(e^{jw}))=2m\pi+\arg(H(e^{jw})) \quad (10)$$

Where m is any integer.

Assuming that the magnitude spectrum at the decoder of FIG. 1 corresponds to $|H(e^{j\omega})|$ the regenerated speech will be degraded to the extent that the phase spectrum used differs from $\arg(H(e^{j\omega}))$.

Considering now the components G, V and L, minimum phase is a good assumption for the vocal tract transfer function V(z). Typically this may be represented by an all-pole model having the transfer function $$V(z) = \frac{1}{\prod_{i=1}^{P}(1-\rho_i z^{-1})} \quad (11)$$

where $\rho_i$ are the poles of the transfer function and are directly related to the formant frequencies of the speech, and P is the number of poles.

The lip radiation filter may be regarded as a differentiator for which:

$$L(z)=1-\alpha z^{-1} \quad (12)$$

where $\alpha$ represents a single zero having a value close to unity (typically 0.95).

Whilst the minimum phase assumption is good for V(z) and L(z), it is believed to be less valid for G(z). Noting that any filter transfer function can be represented as the product of a minimum phase function and an all pass filter, we may suppose that:

$$G(z)=G_{min}(z)\,G_{ap}(z) \quad (13)$$

Figure 3:
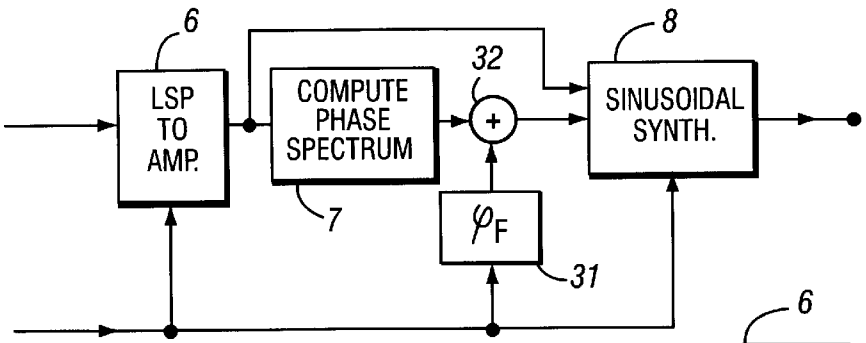
FIG. 3 is a block diagram of a speech decoder according to one embodiment of the present invention.

The decoder shortly to be described with reference to FIG. 3 is based on the assumption that the magnitude spectrum associated with G is that corresponding to $$G_{\min}(z) = \frac{1}{\prod_{i=1}^{2}(1-\beta_i z^{-1})} \quad 14$$

The decoder proceeds on the assumption that an appropriate transfer function for $G_{ap}$ is $$G_{ap}(z) = \frac{(1-\beta_1 z^{-1})(1-\beta_2 z^{-1})}{\left(1-\frac{1}{\beta_1}z^{-1}\right)\left(1-\frac{1}{\beta_2}z^{-1}\right)} \quad 15$$

The corresponding phase spectrum for $G_{ap}$ is $$\begin{aligned}\phi_F(\omega) &= \arg(G_{ap}(e^{j\omega})) \quad 16\\ &= \tan^{-1}\left(\frac{\beta_1 \sin\omega}{1-\beta_1\cos\omega}\right) + \tan^{-1}\left(\frac{\beta_2 \sin\omega}{1-\beta\cos\omega}\right) - \\ &\quad \tan^{-1}\left(\frac{\sin\omega}{\beta_1-\cos\omega}\right) - \tan^{-1}\left(\frac{\sin\omega}{\beta_2-\cos\omega}\right)\end{aligned}$$

In the decoder of FIG. 3, items 6, 7 and 9 are as in FIG. 1. However, the phase spectrum computed at 7 is adjusted. A unit 31 receives the pitch frequency and calculates values of $\phi_F$ in accordance with Equation (17) for the relevant values of ω—i.e. harmonics of the pitch frequency for the current frame of speech. These are then added in an adder 32 to the minimum-phase values, prior to the sinusoidal synthesiser 8.

Experiments were conducted on the decoder of FIG. 3, with a fixed value $\beta_1=\beta_2=0.8$ (though—as will be discussed below—varying β is also possible). These showed an improvement in measured phase error (as shown in FIG. 4) and also in subjective tests (FIG. 5) in which listeners were asked to listen to the output of four decoders and place them in order of preference for speech quality. The choices were scored: first choice=4, second=3, third=2 and fourth=1; and the scores added.

The results include figures for a Rosenberg pulse. As described by A. E. Rosenberg in "Effect of Glottal Pulse Shape on the Quality of Natural Vowels", J. Acoust. Soc. of America. Vol. 49, No. 2, 1971, pp. 583–590, this is a pulse shape postulated for the output of the glottal filter G. The shape of a Rosenberg pulse is shown in FIG. 6 and is defined as:

$$\begin{aligned} g(t) &= A(3(t/T_P)^2 - 2(t/T_P)^3) && 0 \le t \le T_P \quad 17\\ g(t) &= A\left(1-\left(\frac{t-T_P}{T_N}\right)^2\right) && T_P < t \le T_P + T_N\\ g(t) &= 0 && T_p + T_N < t \le p\end{aligned}$$

where p is the pitch period and $T_P$ and $T_N$ are the glottal opening and closing times respectively.

Figure 7:
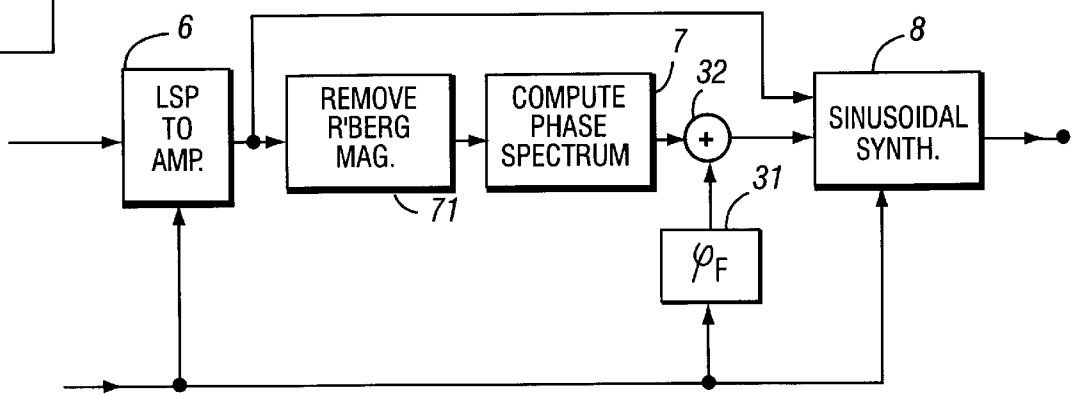
FIG. 7 is a block diagram of a second form of speech decoder according to the invention.

An alternative to Equation 16, therefore, is to apply at 31 a computed phase equal to the phase of g(t) from Equation (17), as shown in FIG. 7. However, in order that the component of the Rosenberg pulse spectrum that can be represented by a minimum phase transfer function is not applied twice, the magnitude spectrum corresponding to Equation 17 is calculated at 71 and subtracted from the amplitude values before they are processed by the phase spectrum calculation unit 7. The results given are for $T_P$=0.33 P, $T_N$=0.1 P.

Figure 8:
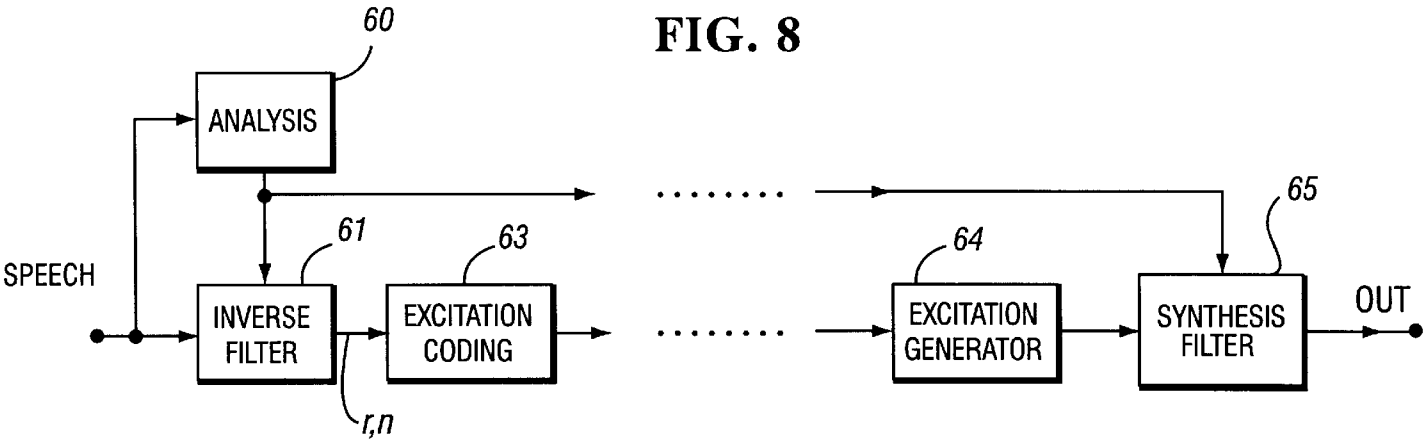
FIG. 8 is a block diagram of a known type of speech coder.

The same considerations may be applied to arrangements in which a coder attempts to deconvolve the glottal excitation and the vocal tract response—so-called linear predictive coders. Here (FIG. 8) input speech is analysed (60) frame-by frame to determine parameters of a filter having a spectral response similar to that of the input speech. The coder then sets up a filter 61 having the inverse of this response and the speech signal is passed through this inverse filter to produce a residual signal r(n) which ideally would have a flat spectrum and which in practice is flatter than that of the original speech. The coder transmits details of the filter response, along with information (63) to enable the decoder to construct (64) an excitation signal which is to some extent similar to the residual signal and can be used by the decoder to drive a synthesis filter 65 to produce an output speech signal. Many proposals have been made for different ways of transmitting the residual information, e.g.

(a) sending for voiced speech a pitch period and gain value to control a pulse generator and for unvoiced speech a gain value to control a noise generator;

(b) a quantised version of the residual (RELP coding)

(c) a vector-quantised version of the residual (CELP coding)

(d) a coded representation of an irregular pulse train (MPLPC coding)

(e) particulars of a single cycle of the residual by which the decoder may synthesise a repeating sequence of frame length (Prototype waveform interpolation or PWI) (See W. B. Kleijn, "Encoding Speech using prototype Waveforms", IEEE Trans. Speech and Audio Processing, Vol 1, No. 4, October 1993, pp. 386–399, and W. B. Kleijn and J. Haagen, "A Speech Coder based on Decomposition of Characteristic Waveforms", Proc ICASSP, 1995, pp. 508–511.

In the event that the phase information about the excitation is omitted from the transmission, then a similar situation arises to that described in relation to FIG. 2, namely that assumptions need to be made as to the phase spectrum to be employed. Whether phase information for the synthesis filter is included is not an issue since LPC analysis generally produces a minimum phase transfer function in any case so that it is immaterial for the purposes of the present discussion whether the phase response in included in the transmitted filter information (typically a set of filter coefficients) or whether it is computed at the decoder on the basis of a minimum phase assumption.

Of particular interest in this context are PWI coders where commonly the extracted prototypical residual pitch cycle is analysed using a Fourier transform. Rather than simply quantising the Fourier coefficients, a saving in transmission capacity can be made by sending only the magnitude and the pitch period. Thus in the arrangement of FIG. 9, where items identical to those in FIG. 8 carry the same reference numerals, the excitation unit 63—here operating according to the PWI principle and producing at its output sets of Fourier coefficients—is followed by a unit 80 which extracts only the magnitude information and transmits this to the decoder. At the decoder a unit 91—analogous to unit 31 in FIG. 3—calculates the phase adjustment values $\phi_F$ using Equation 16 and controls the phase of an excitation generator 64. In this example, the $\beta_1$ is fixed at 0.95 whilst $\beta_2$ is controlled as a function of the pitch period p, in accordance with the following table:

TABLE I

| Pitch | β | Pitch | β |
|---|---|---|---|
| 16–52 | 0.64 | 82–84 | 0.84 |
| 53–54 | 0.65 | 85–87 | 0.85 |
| 54–56 | 0.66 | 88–89 | 0.86 |
| 57–59 | 0.70 | 90–93 | 0.87 |
| 60–62 | 0.71 | 94–99 | 0.88 |
| 63–64 | 0.75 | 100–102 | 0.89 |
| 65–68 | 0.76 | 103–107 | 0.90 |
| 69 | 0.78 | 108–114 | 0.91 |
| 70–72 | 0.79 | 115–124 | 0.92 |
| 73–74 | 0.80 | 125–132 | 0.93 |
| 75–79 | 0.82 | 133–144 | 0.94 |
| 80–81 | 0.83 | 145–150 | 0.95 |

The value of α used in F(z) for the range of pitch periods

These values are chosen so that the all-pass transfer function of Equation 15 has a phase response equivalent to that part of the phase spectrum of a Rosenberg pulse having $T_P$=0.4 p and $T_N$=0.16 p which is not modelled by the LPC synthesis filter 65. As before, the adjustment is added in an adder 83 prior and converted back into Fourier coefficients before passing to the PWI excitation generator 64.

The calculation unit 91 may be realised by a digital signal processing unit programmed to implement the Equation 16.

Figure 9:
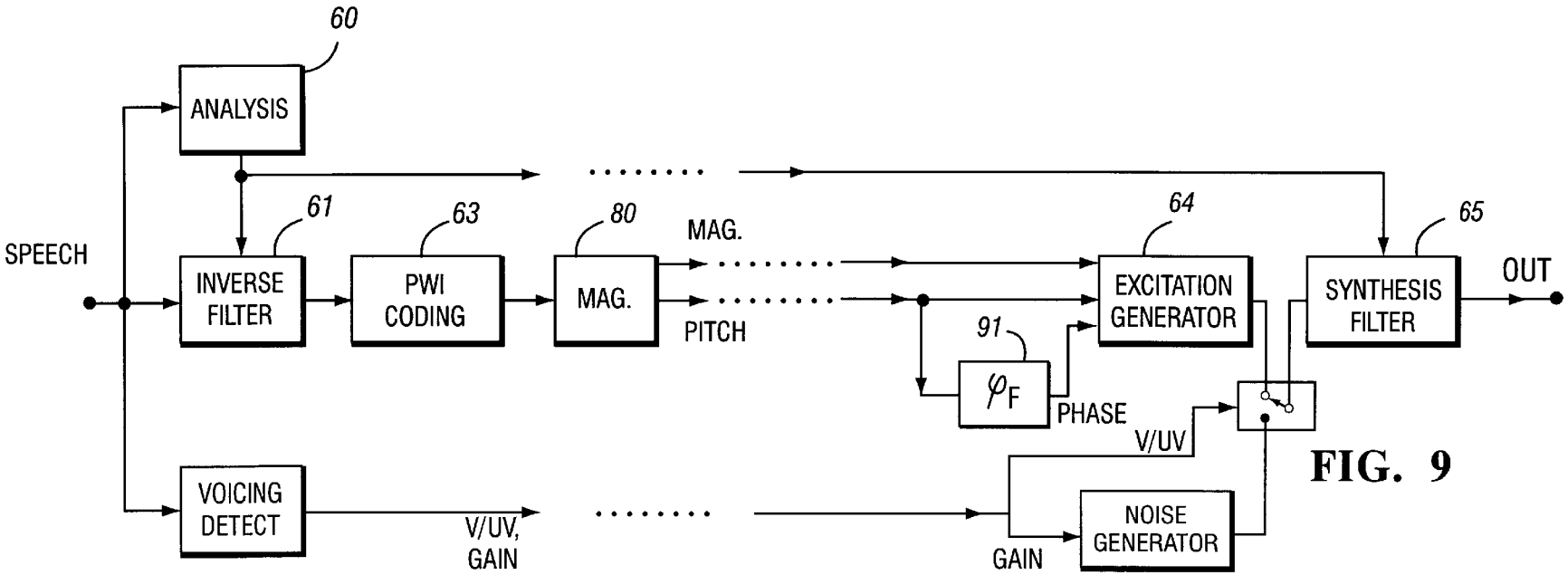
FIG. 9 is a block diagram of a third embodiment of decoder in accordance with the invention, for use with the coder of FIG. 9.
Figure 10:
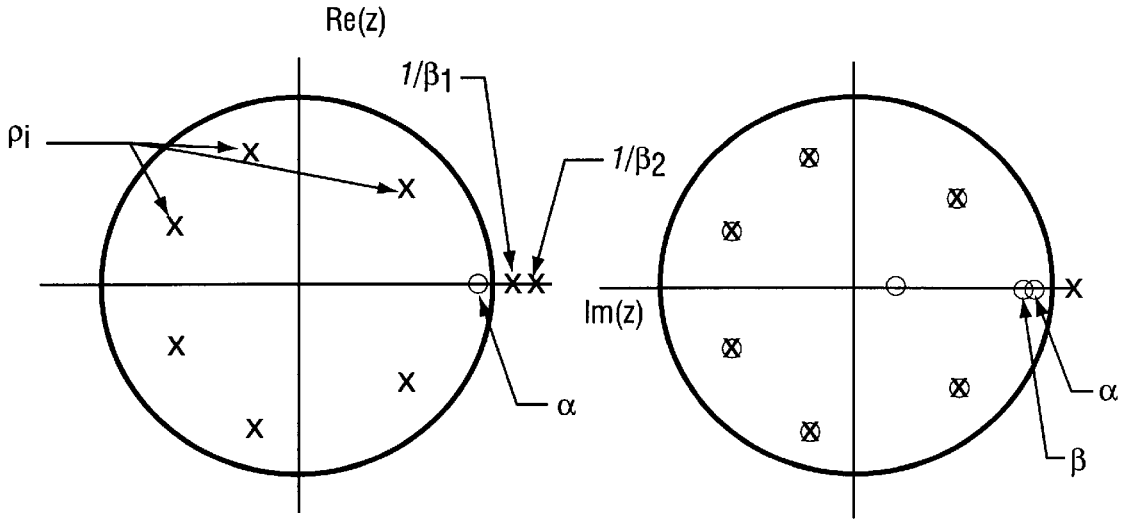
FIG. 10 is a z-plane plot illustrating the invention.

It is of interest to consider the effect of these adjustments in terms of poles and zeroes on the z-plane. The supposed total transfer function H(z) is the product of G, V and L and thus has, inside the unit circle, P poles at $\rho_i$ and one zero at α, and, outside the unit circle, two poles at $1/\beta_1$ and $1/\beta_2$, as illustrated in FIG. 9. The effect of the inverse LPC analysis is to produce an inverse filter 61 which flattens the spectrum by means of zeros approximately coinciding with the poles at $\rho_i$. The filter, being a minimum phase filter, cannot produce zeros outside the unit circle at $1/\beta_1$ and $1/\beta_2$ but instead produces zeros at $\beta_1$ and $\beta_2$, which tend to flatten the magnitude response, but not the phase response (the filter cannot produce a pole to cancel the zero at α but as $\beta_1$ usually has a similar value to α it is common to assume that the α zero and $1/\beta_1$ pole cancel in the magnitude spectrum so that the inverse filter has zeros just at $\rho_i$ and $\beta_1$. Thus the residual has a phase spectrum represented in the z-plane by two zeros at $\beta_1$ and $\beta_2$ (where the β's have values corresponding to the original signal) and poles at $1/\beta_1$ and $1/\beta_2$ (where the β's have values as determined by the LPC analysis). This information having been lost, it is approximated by the all-pass filter computation according to equations (15) and (16) which have zeros and poles at these positions.

This description assumes a phase adjustment determined at all frequencies by Equation 16. However one may alternatively apply Equation 16 only in the lower part of the frequency range—up to a limit which may be fixed or may depend on the nature of the speech, and apply a random phase to higher frequency components.

The arrangements so far described for FIG. 9 are designed primarily for voiced speech. To accommodate unvoiced speech, the coder has, in conventional manner, a voiced/unvoiced speech detector 92 which causes the decoder to switch, via a switch 93, between the excitation generator 64 and a voice generator whose amplitude is controlled by a gain signal from the coder.

Although the adjustment has been illustrated by addition of phase values, this is not the only way of achieving the desired result; for example the synthesis filter 65 could instead be followed (or preceded) by an all-pass filter having the response of Equation (15).

It should be noted that, although the decoders described have been presented in terms of the decoding of signals coded and transmitted thereto, they may equally well serve to generate speech from coded signals stored and later retrieved—i.e. they could form part of a speech synthesiser.

What is claimed is:

1. A decoder for speech signals comprising:

means for receiving magnitude spectral information for synthesis of a time-varying signal;

means for computing, from the magnitude spectral information, phase spectrum information corresponding to a minimum phase filter which has a magnitude spectrum corresponding to the magnitude spectral information;

means for generating, from the magnitude spectral information and the phase spectral information, the time-varying signal; and phase adjustment means operable to modify the phase spectrum of the signal, the phase adjustment means being operable to adjust the phase in accordance with the transfer function of an all-pass filter having, in a z-plane representation, at least one pole outside the unit circle.

2. A decoder according to claim 1 in which the phase adjustment means are arranged in operation to modify the phase of the signal after generation thereof.

3. A decoder according to claim 1 in which the phase adjustment means are operable to adjust the phase in accordance with the transfer function of an all-pass filter having, in a z-plane representation, two real zeros at positions $\beta_1$, $\beta_2$ inside the unit circle and two poles at positions $1/\beta_1$, $1/\beta_2$ outside the unit circle.

4. A decoder according to claim 1 in which the position of the or each pole is constant.

5. A decoder according to claim 1 in which the adjustment means are arranged in operation to vary the position of the or a said pole as a function of pitch period information received by the decoder.

6. A decoder for decoding speech signals comprising information defining the response of a minimum phase synthesis filter and, for synthesis of an excitation signal, magnitude spectral information, the decoder comprising:

means for generating, from the magnitude spectral information, an excitation signal;

a synthesis filter controlled by the response information and connected to filter the excitation signal; and phase adjustment means for estimating a phase-adjustment signal to modify the phase of the signal, the phase adjustment means being operable to adjust the phase in accordance with the transfer function of an all-pass filter having, in a z-plane representation, at least one pole outside the unit circle.

7. A decoder according to claim 6 in which the excitation generating means are connected to receive the phase adjustment signal so as to generate an excitation having a phase spectrum determined thereby.

8. A decoder according to claim 6 in which the phase adjustment means are arranged in operation to modify the phase of the signal after generation thereof.

9. A decoder according to claim 6 in which the phase adjustment means are operable to adjust the phase in accordance with the transfer function of an all-pass filter having, in a z-plane representation, two real zeros at positions $\beta_1$, $\beta_2$ inside the unit circle and two poles at positions $1/\beta_1$, $\beta_2$ outside the unit circle.

10. A decoder according to claim 6 in which the position of the or each pole is constant.

11. A decoder according to claim 6 in which the adjustment means are arranged in operation to vary the position of the or a said pole as a function of pitch period information received by the decoder.

12. A method of coding and decoding speech signals, comprising:

(a) generating signals representing the magnitude spectrum of the speech signal;

(b) receiving the signals;

(c) generating from the received signals a synthetic speech signal having a magnitude spectrum determined by the received signals and having a phase spectrum which corresponds to a transfer function having, when considered as a z-plane plot, at least one pole outside the unit circle.

13. A method according to claim 12 in which the phase spectrum of the synthetic speech signal is determined by computing a minimum-phase spectrum from the received signals and forming a composite phase spectrum which is the combination of the minimum-phase spectrum and a spectrum corresponding to the said pole(s).

14. A method according to claim 12 in which the signals include signals defining a minimum-phase synthesis filter and the phase spectrum of the synthetic speech signal is determined by the defined synthesis filter and by a phase spectrum corresponding to the said pole(s).

* * * * *